United States Patent [19]

Lynn

[11] Patent Number: 4,495,728

[45] Date of Patent: Jan. 29, 1985

[54] WINDOW ESCAPE DEVICE

[76] Inventor: Gary Lynn, Box 2042, Boulder, Colo. 80306

[21] Appl. No.: 476,109

[22] Filed: Mar. 17, 1983

[51] Int. Cl.[3] ..... E05B 65/10

[52] U.S. Cl. ..... 49/141; 49/395

[58] Field of Search ..... 49/141, 395, 261, 465, 49/389; 292/226, 221

[56] References Cited

U.S. PATENT DOCUMENTS

| | | | |
|---|---|---|---|
| 781,272 | 1/1905 | Dalrymple | 292/221 |
| 2,660,274 | 11/1953 | Donathan | 49/141 |
| 3,210,066 | 10/1965 | Czaplicke et al. | 49/272 |
| 3,391,674 | 7/1968 | Burleigh | 49/324 X |
| 3,461,609 | 8/1969 | Armstrong | 49/324 |
| 3,722,938 | 3/1973 | Bauer et al. | 49/141 X |
| 3,724,130 | 4/1973 | Bogne | 49/141 |
| 3,739,527 | 6/1973 | Schubach | 49/141 X |
| 3,758,140 | 9/1973 | Prete, Jr. | 292/226 X |
| 4,106,236 | 8/1978 | Oliphant | 49/141 |
| 4,143,895 | 3/1979 | Kirchweger et al. | 49/465 X |
| 4,237,654 | 12/1980 | Landem et al. | 49/141 |
| 4,283,885 | 8/1981 | Remick et al. | 49/141 X |

*Primary Examiner*—Kenneth Downey

*Attorney, Agent, or Firm*—Leonard Bloom

[57] ABSTRACT

A latching mechanism for basement windows adapted to allow the basement window to be moved from a closed position to an opened one for emergency escape.

14 Claims, 9 Drawing Figures

WINDOW ESCAPE DEVICE

BACKGROUND OF THE INVENTION

The following relates generally to mechanisms which allow the deployment of windows and the like from a closed position to an opened position, particularly during emergencies.

Emergencies frequently require escape from the room one happens to be in, rather than allowing migration from one room to another for conventional exit as through doors. Such emergency situations, particularly fires require that the lower that one is to the ground, the less smoke and heat one endures. When one is trapped in the basement for example, very few buildings have doors allowing access to the exterior, and people located in the basement may therefore be trapped.

The instant application is directed to a device particularly suitable for use with basement type windows which allow the deployment of the window from a closed position to an opened one with a modicum of effort, and can be easily manipulated by the young, the old, and the infirm.

While it has been known in the past to provide emergency doors or accessories for windows and the like to assist in the escape process, the known prior art manifests difficulties when contrast with the instant invention.

The following citations reflect the state-of-the-art of which applicant is aware, insofar as these citations appear to be germane to the process at hand.

| | |
|---|---|
| 3,210,066 | Czaplicke et al. |
| 3,391,674 | Burleigh |
| 3,462,609 | Armstrong |
| 3,739,527 | Schubach |
| 3,722,938 | Bauer et al. |
| 3,724,130 | Bogue |
| 4,283,885 | Remick et al. |

Each of the citations teaches the use of a mechanism associated with actuation of a door, window, or the like. For example, Bauer et al. U.S. Pat. No. 3,722,938 teaches the use of a familiar emergency exit door and unlatching mechanism that includes first and second pivotable members 38 interconnected by bar 16 as shown in FIG. 2.

The patent to Remick et al. U.S. Pat. No. 4,283,885 teaches the use of a similar type of emergency release closure capable of being disposed on mass transit vehicles, with the operative features shown in detail in FIG. 2.

The patent to Schubach U.S. Pat. No. 3,739,527 is of interest since he teaches the use of a lever handle 32, 33 and a means for rotating same which allows rotation of an associated window.

The patent to Czaplicke et al. U.S. Pat. No. 3,210,066 teaches the use of a linkage structure which includes a foot operated apparatus for door actuation, in which the curved surface 26 interacts with a plurality of links suitably pivoted to allow the door to move from a first to a second position.

The remaining citations show the state-of-the-art further and are believed to diverge even more from that which is defined as the essence of the invention as will be disclosed hereinafter.

More particularly, the instant invention is distinguished over the known prior art by modifying a conventional basement type window by first removing the conventional means for attachment of the window to its associated frame, attaching on two upper corners thereof latching means which when unlatched allows the window to pivot from a fixed closed position outwardly away from the room associated with the window, and removable pin means disposed on a lower edge of the window adapted to reside within appropriate recess means on the lower portion of the frame so that the entire window may be removed. In a further form of the invention, an associated linkage is provided with the latching means that permits easy actuation of the latching means from a first to a second position. In addition, the invention contemplates as one of the features thereof the utilization of a ladder which when deployed from a stored to a in use position, automatically unlatches the latching means to permit instantaneous removal of the window.

SUMMARY AND OBJECTS OF THE INVENTION

Accordingly, this invention has as its objective the provision of a new and improved safety device adapted to be used particularly with windows, and especially basement type windows.

A further object of this invention contemplates providing a device as characterized above which is easily deployable even for the old, the young, and the infirm.

A further object of this invention contemplates providing a device as characterized above which is relatively inexpensive, easily deployable, and lends itself to mass production techniques.

A further object of this invention contemplates providing a device as characterized above which does not interfere with the normal appearance of the room, and would not interfere with the disposition of curtains, drapes, or the like normally found over windows.

A further object of this invention contemplates providing a device as characterized above which requires no maintenance during the course of its life, and benefits from a mechanical advantage for the facile deployment thereof. Herein there has been provided an instrumentality readily adaptable to conventional basement type windows. These windows are characterized by a bottom hinge running along a lowermost edge thereof, and first and second links disposed on sides of the window and attached to the window frame for pivotable movement between a first and a second position, the window pivoting inwardly in many cases. A latch is provided on the topmost edge of the window to allow the window to be moved from a first or second position. The instrumentality associated with the instant application removes all known connecting mechanisms between the window and the window frame and provides first and second latching means at upper right and left-hand corners of the window, the latching means being interconnected by a lever bar, and associated linkage operatively connected thereto which may include a ladder intergrally formed therewith or a suitable linkage which when manipulated appropriately, causes the latching means of on the window to disengage the window frame. The window is adapted to move from a first closed position to a second position outside of the building, and the entire window is readily removable by means of special retaining pins disposed on the bottom edge of the window for the associated benefits. When installed and suitably latched, the window is secure and it is not readily susceptible to thieves attempting to break into the house at that area. However, in an emergency situation, the glass associated with the window can be broken and the device can be actuated from without the building as readily as it would be activated from within the building.

Other objects and advantages will become manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENT

Figure 1:
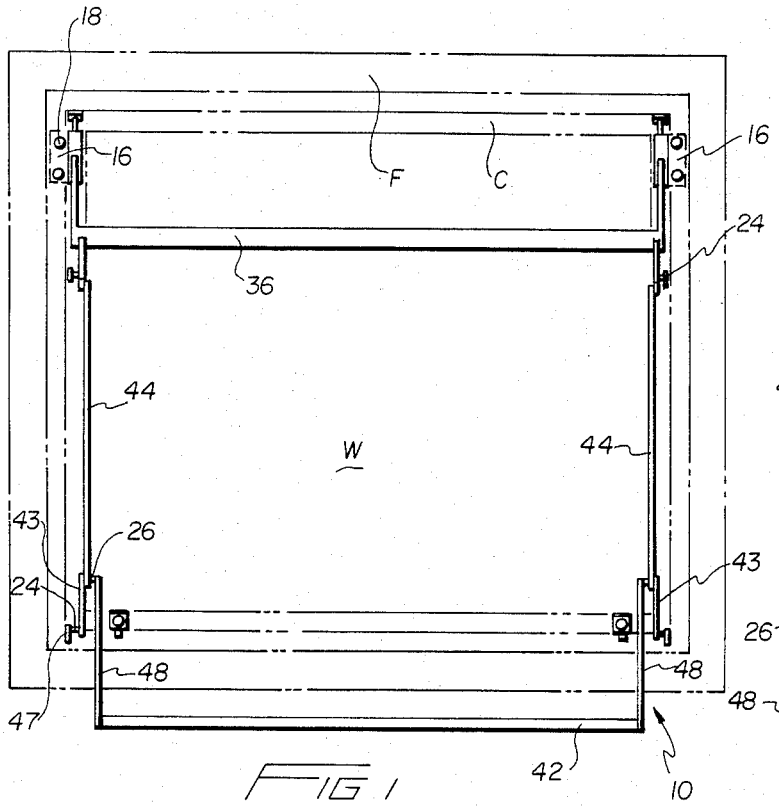
FIG. 1 is a front plan view of the apparatus in one form according to the present invention.

Referring to the drawings now, wherein like reference numerals refer to like parts throughout the various drawing figures, reference numeral 10 is directed to a window latching system according to one form of the invention which is also known as "SCAPEZE $_{TM}$".

The latching system is suitably fashioned for disposition on a window W provided with a peripheral casement C, the casement adapted to be nestably supported in a window frame F, the frame F embedded in a basement wall, for example, and defining an opening which the window W closes.

Figure 3:
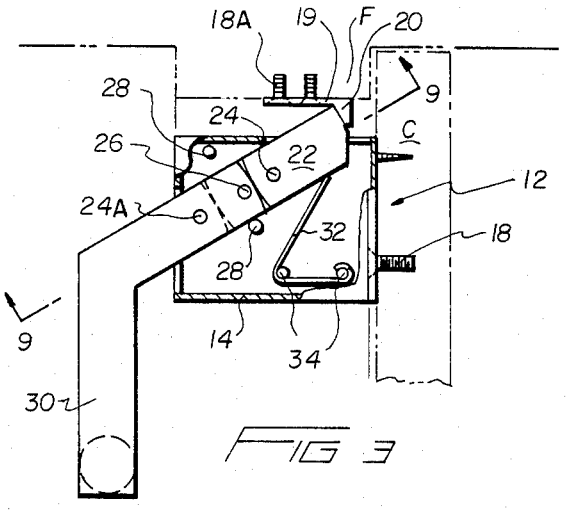
FIG. 3 is a partial sectional view showing one of the latching mechanisms disposed in the two upper corners of the window.
Figure 4:
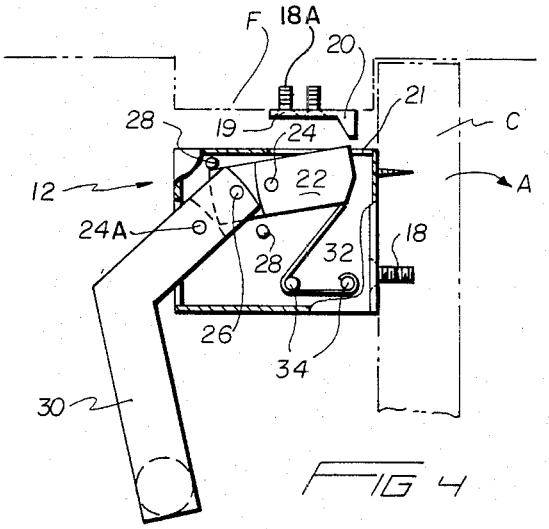
FIG. 4 is a view similar to FIG. 3 showing the latching mechanism in a second or unlatched position when contrasted with FIG. 3.

The latching system 10 includes a latching means 12 disposed in the two upper corners of the window casement C and is affixed thereto in the following manner. The latching means 12 includes a housing 14 of substantially rectangular box shaped configuration having a laterally and outwardly extending tab 16 provided with suitable holes for the passage therethrough of screws 18, which screws are embedded in the casement C. The frame F has disposed adjacent the housing 14 a retention plate 19 screwed to a peripheral rim of the frame F by means of screws 18A, the retention plate 19 being of substantially L shaped configuration and including a downwardly extending lip 20 which is beveled as shown in FIGS. 3 and 4 for example.

A top surface of the housing 14 has an opening 21 which allows a retainer catch 22 to communicate with the lip 20 on the retention plate 19. As is shown in FIGS. 3 and 4, the retainer catch 22 has a beveled surface complemental to the bevel of the lip 20 so that the beveled surfaces are in abutting tangential registry when the window is in the latched position. The retainer catch 22 is pivotably mounted within the housing by means of a first fixed pivot pin 24 and is therefore adapted to rotate about the fixed pivot pin as shown in the two drawings depicting the latched and unlatched mode. In addition, a moving pivot pin 26 connects the retainer catch 22 with an actuating lever 30, the lever 30 shown as being of substantially L shaped configuration, and having first and second leg portions as shown more clearly in FIGS. 3 and 4. The actuating lever 30 is pivotably held in fixed relation within the housing by means of a further (or second) fixed pivot pin 24A, so that the retainer catch 22 and the actuating lever 30 can move between one of two positions by virtue of their interconnection with the moving pivot pin 26. As shown, the limit of travel of the catch 22 and the lever 30 is limited by first and second stop pins 28 also held in fixed relationship in the housing wall. When the window is in the latched position, one leg of the L shaped actuating lever is colinear with the retainer catch 22, and when in the unlatched position the retainer catch is pivoted down within the opening 21, clear of the lip 20 so that the window can be moved in the direction of the arrow A. When the catch 22 is in the retracted position as shown in FIG. 4, it is working against the biasing of an L shaped spring 32, the spring 32 being attached in the housing by means of two pins 34. Thus, the catch 22 exhibits a natural tendency to rotate to the latched position thereby engaging the lip 20 in the absence of pressure from the actuating lever 30. Dimensionally, the actuating lever 30 is four to five times longer than the catch 22 so that substantial mechanical advantage is provided and children, old people and the infirm can easily actuate the latching mechanism. There are two latching mechanisms associated with each window in a preferred form of the invention, both can be actuated simultaneously by having the actuating arm 30 interconnected by a transversely disposed push bar 36.

Figure 5:
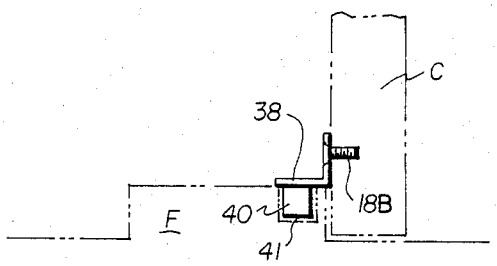
FIG. 5 is directed to a means for attaching the window to the window frame along the lowermost edge thereof.
Figure 6:
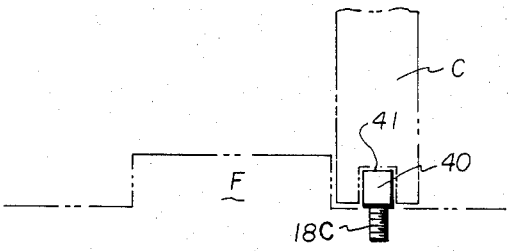
FIG. 6 is a second form of that which is shown in FIG. 5.

In a preferred form of the invention, it is contemplated that the bottom of the window also be separable from the associated frame. To this end, two means of removably attaching the bottom of the window casement C relative to the frame F are contemplated. As shown in FIG. 5, an L shaped tang 38 extends between the frame F and the casement C. The upwardly extending vertical leg of the tang 38 is fixedly secured to the casement C by means of a screw 18B, and the tang is removably attached into an opening 41 disposed in the frame by means of a downwardly extending cylinder 40 integrally formed with a horizontal leg of the tang 38. In FIG. 6, the screw 18C is attached into the frame F adjacent its rim, and the cylinder 40 extends into an opening 41 of the casement C.

Thus, the invention in its essence has been delineated, and the ensuing description relates to two variations that may be regarded as accessories.

Figure 2:
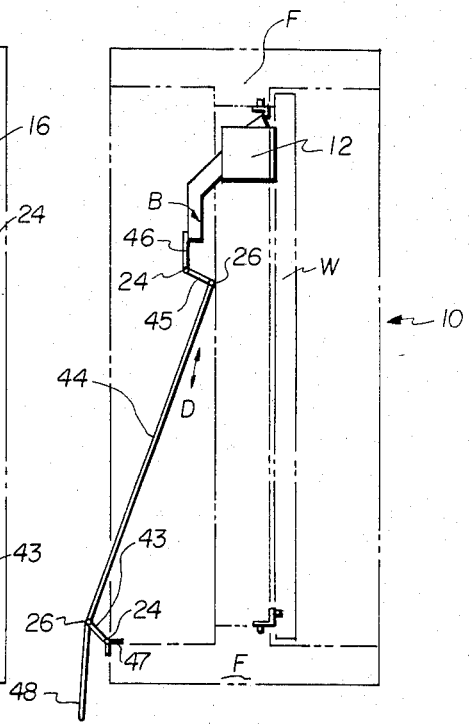
FIG. 2 is a side view thereof.

FIGS. 1 and 2 depict a manually-operably linkage means extending below the window sill and comprising an extension device for allowing the push bar to be manipulated by people of various heights. More particularly, the rim of the window frame F is provided with a lower pivot 24 fixed to the rim edge by means of an L shaped bracket 47. A link 43 is attached to the bracket 47 by means of the pivot 24, and the terminus of the link 43 remote therefrom is provided with a further pin 26 which connects an upwardly and inwardly extending rod 44 and a further bar member 42 parallel to the push bar 36. The parallel bar 42 includes a central bite portion 42 and two upwardly extending legs 48, the ends of the legs 48 remote from the parallel rod 42 pivoted at 26 to the rod 44. The end of the rod 44 remote from rod 42 is connected by movable pivot 26 to linkage 45 so that the rod 44 can move in a direction of the arrow D when rod 42 is pulled downwardly. This causes the second linkage 45 which is fixed at an end remote from the movable pivot 26 by means of a fixed pivot pin 24 and an associated upwardly extending push bar engaging member 46 to rotate whereby tugging or downward motion on the parallel rod 42 causes rotation of the push bar engaging member 46 in the direction of the arrow B.

Figure 7:
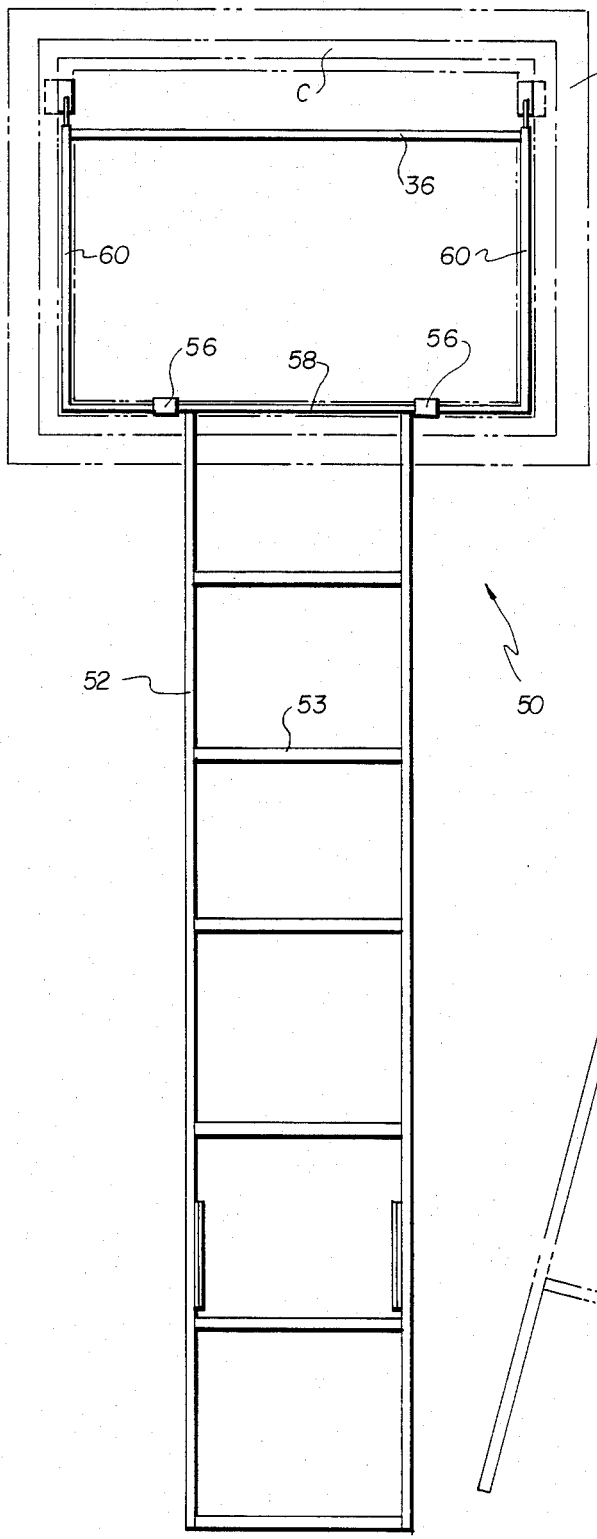
FIG. 7 shows a varient from that which is shown in FIG. 1.
Figure 8:
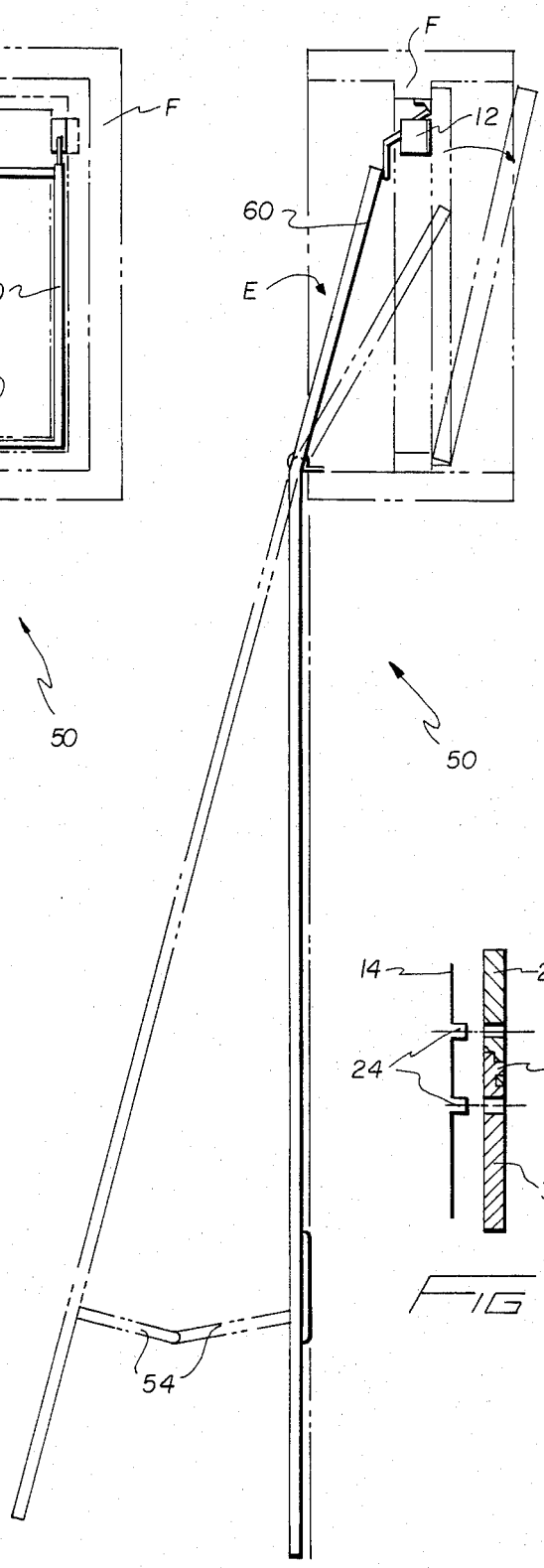
FIG. 8 is a side view of that which is shown in FIG. 7.
Figure 9:
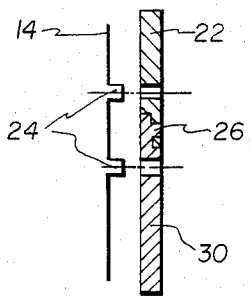
FIG. 9 is a sectional view taken along lines 9-9 of FIG. 3.

A second varient as shown in FIGS. 7 and 8 includes an upwardly extending U shaped mechanism which engages the push bar 36. More particularly, the U shaped portion includes a bite area 58 and two legs 60, the bite portion being disposed on the ledge of the window frame and fixed thereto by means of pivots 56 which allow rotation of the bite 58 and therefore motion of the legs 60 in the direction of the arrows E in FIG. 8. The bite portion 58 is caused to rotate by means of its connection to a downwardly extending ladder 52 having a plurality of rungs 53 so that when the ladder is moved from a stored position as shown in FIG. 8 in dark lines to a deployed position as shown in phantom, the window opens automatically. The ladder 52, 53 is held in fixed relationship away from the wall when its use is desired by means of first and second links 54 that move from a folded stored position to an open outwardly extending position away from the wall of the basement.

Having thus described the invention, it should be apparent that numerous structural modifications are contemplated as being a part of this invention as set forth hereinabove and as defined hereinbelow by the claims.

I claim:

1. A device for facilitating egress form a window comprising in combination:

latching means adjacent a top area of the window cooperating with latch retention means disposed on an associated window frame upper portion in registry with said latching means, fastening means removeably interconnecting a lower area of the window with the adjacent associated window frame lower portion, whereby activation of said latching means allows the window to move in relation to the frame initially and thereafter allow dissociation of the window from the frame through said fastening means separation, said latching means operatively conditioned by ladder means which is adapted to move form a first stored position to a second deployed position whereupon said latching means is automatically tripped, and wherein said ladder means includes an upwardly extending U shaped portion having a bite portion and two upwardly extending legs, said bite portion disposed on a ledge of the window frame and fixed thereto by pivot means, said upwardly extending legs having termimi adapted to engage said latching means.

2. The device of claim 1, wherein said latching means includes first and second housings disposed in upper corners of the window fastened to a casement of the window, said housings each having an opening on a top thereof which includes a catch adapted to move within and without said housing opening and engage said latch retention means.

3. The device of claim 2, wherein said latch retention means includes a retention plate disposed on the window frame having a downwardly depending lip adapted to engage said catch.

4. The device of claim 3, wherein said catch is fixed in said housing by means of a first pivot supporting said catch to said housing, said catch pivotably connected to an actuating lever which extends without said housing.

5. The device of claim 4, wherein said actuating lever is attached to said housing by means of a fixed pivot extending therebetween and the range of motion obtainable by said actuating lever and said catch is limited by means of said first and second pin stops disposed on opposed sides of said catch.

6. The device of claim 5, wherein said catch is urged to engage and be retained by said retention plate lip by means of a spring which biases said catch towards said retention plate, said spring retained in said housing by means of first and second pins, said actuating levers have lowermost portions which are interconnected by means of a push bar, said fastening means comprises a pin member extending from either the window or frame and an associated recess in the frame or window, respectively, whereby motion of the window through actuation of said latching means provide clearance to allow dissociation of said pin form said recess.

7. A device for facilitating egress from a window comprising in combination:

latching means adjacent a top area of the window cooperating with latch retention means disposed on an associated window frame upper portion in registry with said latching means, fastening means removeably interconnecting a lower area of the window with the adjacent associated window frame lower portion, whereby activation of said latching means allows the window to move in relation to the frame initially and thereafter allow dissociation of the window from the frame through separation of said fastening means, said latching means operatively conditioned by linkage means extending below said latching means and providing mechanical advantage to said latching means, wherein said linkage means includes a bracket disposed on the sill of the window frame pivotably supporting a link adapted to communicate at a terminus remote from said bracket with an upwardly extending rod, said rod having a terminus adjacent said latching means pivotably attached to a push bar engaging member, said push bar engaging member adapted to rotate and thereby actuate said latching means.

8. The device of claim 7, wherein said rod is connected at a lowermost extremity to a U shaped bar having a central bite portion and two upwardly extending legs communicating with a pair of said linkage means, whereby mechanical advantage is achieved by actuating said U shaped bar.

9. The device of claim 8, wherein said latching means includes first and second housings disposed in upper corners of the window fastened to a casement of the window, said housings each having an opening on a top thereof which includes a catch adapted to move within and without said housing opening and engage said latch retention means, said latch retention means includes a retention plate disposed on the window frame having a downwardly depending lip adapted to engage said catch, said catch is fixed in said housing by means of a first pivot supporting said catch to said housing, said catch pivotably connected to an actuating lever which extends without said housing, said actuating lever is attached to said housing by means of a fixed pivot extending therebetween and the range of motion obtainable by said actuating lever and said catch is limited by means of said first and second pin stops disposed on opposed sides of each said catch.

10. The device of claim 9, wherein said catch is urged to engage and be retained by said retention plate lip by means of a spring which biases said catch towards said retention plate, said spring retained in said housing by means of first and second pins, said actuating levers have lowermost portions which are interconnected by means of a push bar, said fastening means comprises a pin member extending from either the window or frame and an associated recess in the frame or window respectively, whereby motion of the window through actuation of said latching means provide clearance to allow dissociation of said pin from said recess.

11. In a window escape device, wherein a window is mounted within a casement mounted in turn within a frame, and wherein removable attaching means is provided between the casement and the frame at the bottom of the window, the improvement which comprises a housing secured to the top of the window, the housing having an opening formed therein, a retention plate secured to the frame and having a lip portion protruding therefrom, a catch pivotably mounted on a fixed pivot in the housing, resilient means constantly urging the catch in a direction outwardly of the housing, wherein in a latched position of the device, the catch extends through the opening in the housing and engages the lip portion of the retention plate, a bent actuating lever pivotably mounted on a second fixed pivot in the housing, the actuating lever providing a mechanical advantage and having a leg portion pivotably connected to a portion of the catch by a movable pivot, the lever further having a second leg portion extending below the housing, whereby the lever may be pivoted to retract the catch within the housing against the force of the resilient means, thereby moving the device into an unlatched position to facilitate subsequent removal of the window, and stop means in the housing for limiting the pivotal movement of the catch and lever, respectively.

12. The improvement of claim 11, wherein two housings are provided, one at each upper corner of the window, wherein two actuating levers are provided, and wherein the lower ends of the respective lever legs are connected together by a push bar.

13. The improvement of claim 12, further including manually-operable linkage means extending below the window sill for actuating the push bar.

14. The improvement of the claim 13, wherein the window comprises a basement window, and wherein the linkage means includes a ladder for access to the basement window.

* * * * *